US005124759A

United States Patent [19]

Fukuchi et al.

[11] Patent Number: 5,124,759

[45] Date of Patent: Jun. 23, 1992

[54] CONTROL METHOD FOR DETECTING A PAPER JAM USING A TONER DENSITY SENSOR

[75] Inventors: Yutaka Fukuchi, Tokyo; Koichi Kanaya, Yokohama; Yoshiyuki Tanimoto, Tokyo, all of Japan

[73] Assignee: Ricoh Company, Ltd., Tokyo, Japan

[21] Appl. No.: 619,607

[22] Filed: Nov. 29, 1990

[30] Foreign Application Priority Data

Nov. 29, 1989 [JP] Japan ..... 1-137312[U]
Mar. 2, 1990 [JP] Japan ..... 2-20494[U]

[51] Int. Cl.[5] ..... G03G 21/00
[52] U.S. Cl. ..... 355/316; 355/205
[58] Field of Search ..... 355/206, 205, 316, 207

[56] References Cited

U.S. PATENT DOCUMENTS 4,239,372 12/1980 Iwai ..... 355/246
4,313,671 2/1982 Kuru ..... 355/214
4,797,705 1/1989 Nishioka ..... 355/207
4,954,848 9/1990 Arima ..... 355/316 X

FOREIGN PATENT DOCUMENTS 0206785 8/1988 Japan .

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A control method for an image recorder of the type transporting a recording medium substantially vertically from a lower portion to an upper portion inside the recorder. This type of recorder transfers a toner image from a photoconductive element to the medium, and has a toner density sensor for sensing the toner density of a reference density pattern. When the medium jams in the transport path while being transported in the vertical direction, whether it has slipped out of the transported path and dropped to a position where the toner density sensor is located is determined, the sensor is turned on when the operator starts on an operation for removing the medium and when the operator ends such an operation. When the resultant two consecutive outputs from the sensor are different from each other, it is determined that the medium has dropped and the jam is in the vicinity of the sensor.

15 Claims, 10 Drawing Sheets

CONTROL METHOD FOR DETECTING A PAPER JAM USING A TONER DENSITY SENSOR

BACKGROUND OF THE INVENTION

The present invention relates to a method of controlling an image recorder of the type forming a toner image on a photoconductive element, or image carrier, transferring the toner image to a recording medium, and fixing the toner image on the medium. More particularly, the present invention is concerned with an image recorder control method capable of detecting a medium jammed a transport path and then slipped out of the path in the event of removal.

An electrophotographic copier, facsimile transceiver, laser beam printer or similar electrophotographic image recorder is extensively used today. A predominant type of electrophotographic copier, for example, has a transport path defined in a lower portion thereof and extending substantially horizontally to an image transfer station. A recording medium in the form of a paper sheet is driven along the transport path to contact the surface of a photoconductive element at the image transfer station, whereby a toner image is transferred from the photoconductive element to the sheet. The paper sheet carrying the toner image thereon is further transported to a fixing station.

On the other hand, there is an increasing demand for a miniature copier and, therefore, an implementation for promoting efficient use of the space available in a copier. In this sense, the transport path extending horizontally in a copier as stated above is not desirable. For this reason, an electrophotographic copier having a substantially vertically extending transport path has been recently developed. In this kind of copier, a developing unit, image transferring and paper separating unit and other process units are arranged along the vertical transport path. A paper sheet is transported along such a path to an image transfer station and caused into contact with the surface of a photoconductive element there. As a result, a toner image is transferred from the photoconductive element to the paper sheet. When the photoconductive element is implemented with a belt, for example, it is held in an inclined position to adjoin the vertical transport path while the image transferring and paper separating unit is located to face a part of the belt that faces the belt. A paper sheet transported along the vertical transport path to the image transferring and paper separating unit is caused into contact with the surface of the belt.

In an image recorder having a vertical transport path as described above, a paper sheet coming out of the image transferring and paper separating unit and carrying a toner image thereon is driven substantially vertically along the path toward a fixing unit. At this instant, since the toner image on the paper sheet has not been fixed yet, it is not allowable to nip the paper sheet by rollers or similar members at both sides thereof. Usually, therefore, only the back or non-imaged side of the paper sheet is held by rollers. When a paper sheet jams the transport path between the belt and the image transferring and paper separating unit, the unit is moved away from the belt to remove the paper sheet. So long as the paper sheet to be removed has a relatively large size, it will have been caught at the leading edge thereof by a register roller pair located at the inlet of the developing unit or caught at the trailing edge thereof by rollers of the fixing unit. Such a sheet, therefore, will remain on the transport path during and even at the end of the removing operation. However, when the size of the jamming sheet is relatively small, it is likely that neither the leading edge nor the trailing edge thereof has been retained by the register roller pair of the rollers of the fixing unit. Then, at the time when the image transferring and paper separating unit is moved away from the belt, the paper sheet is apt to drop along the surface of the belt and thereby slip out of the transport path. Should the image recorder be driven again with the dropped paper sheet being unnoticed by the operator, the sheet would cause a serious trouble to occur. Specifically, when the paper sheet drops into the cleaning unit or the developing unit, it causes a cleaning agent or a developer to overflow the associated unit. In such a case, the image recorder cannot be restored to normal unless the developer is replaced or all the parts and elements surrounding the belt are cleaned up. Moreover, the jamming paper sheet is apt to physically damage the belt. While a pawl or a blade made of resin is an anti-drop approach proposed in the past, it is not satisfactory when it comes to an image recorder which has to operate at high speed and be miniature.

SUMMARY OF THE INVENTION

It is therefore an object of the present invention to provide an image recorder control method capable of detecting a jamming paper sheet slipped out of a transport path in the event of removal.

It is another object of the present invention to provide a generally improved image recorder control method.

In accordance with the present invention, in an image recorder comprising a transport path for transporting a recording medium substantially vertically from a lower portion to an upper portion of the recorder, a developing unit for developing a latent image electrostatically formed on an image carrier by a toner to produce a toner image, an image transferring and medium separating unit extending along the transport path for transferring the toner image from the image carrier to the medium and then separating the medium from the image carrier, and a toner density sensor located between the image transferring and medium separating unit and the developing unit, an image recorder control method comprising the steps of sensing the density of a toner image representative of a reference density pattern formed on the image carrier by the toner density sensor and setting the sensed density as a first sensed level, sensing, on the lapse of a predetermined period of time, the density of a toner image representative of the reference pattern formed on the image carrier by the toner density sensor and setting the sensed density as a second sensed level, comparing the first and the second sensed levels, and determining, when the first and second sensed levels are different from each other, that the medium has slipped out of the transport path and exists in the vicinity of the toner density sensor and then executing necessary processing.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
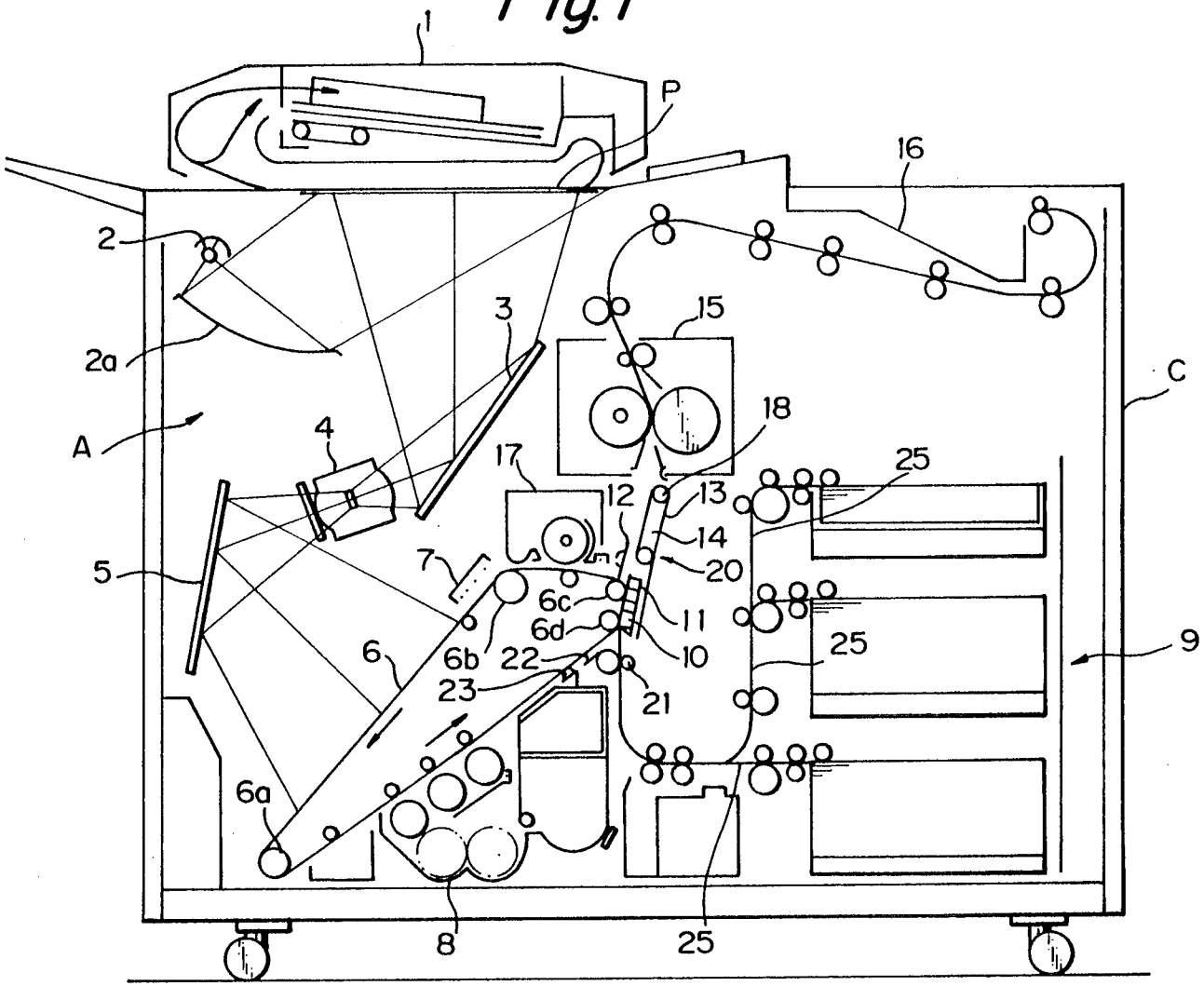
FIG. 1 is a section of an electrophotographic copier which is a specific form of an image recorder implemented with a control method embodying the present invention.

Referring to FIG. 1 of the drawings, en electrophotographic copier to which an image recorder control method embodying the present invention is applied is shown. As shown, the copier has a casing C and an automatic document feeder (ADF) 1 disposed above the casing C. A glass platen P is mounted on the top of the casing C. Optics A is accommodated in the casing C below the glass platen P and has a lamp 2, a reflector 2*a*, a first mirror 3, a lens 4, and a second mirror 5. A photoconductive element in the form of a belt 6 is located face the second mirror 5 and passed over rollers 6*a* to 6*d*. The belt 6 is held in an inclined position and movable in a direction indicated by an arrow in the figure. A paper transport path extends substantially vertically in the vicinity of the belt 6 and between the rollers 6*c* and 6*d*. A guide pawl 12 is provided on the transport path. A cleaning unit 17 is located above the belt 6 and in close proximity to the surface of the belt 6. A main charger 7 adjoins the cleaning unit 17 and faces the surface of the belt 6. A developing unit 8 is disposed below the belt 6 in such a manner as to be movable toward and away from the belt 6. An image transferring and paper separating unit 20 extends along the transport path and is movable toward and away from the surface of the belt 6. A fixing unit 15 is located above the unit 20. A copy tray 16 is provided on the top of the casing C. A paper feeding section 9 is disposed in and at one end of the casing C and loaded with paper sheets 25. A paper sheet 25 fed from the paper feeding section 9 is steered upward in a substantially vertical direction from a lower portion of the casing copier. On the paper transport path between the rollers 6*c* and 6*d*, the paper sheet 25 is caused into contact with the surface of the belt 6. Then, the image transferring and paper separating unit 20 transfers a toner image formed on the belt 6 by the developing unit 8 to the paper sheet 25, and then separates the paper sheet 25 from the belt 6.

Figure 2:
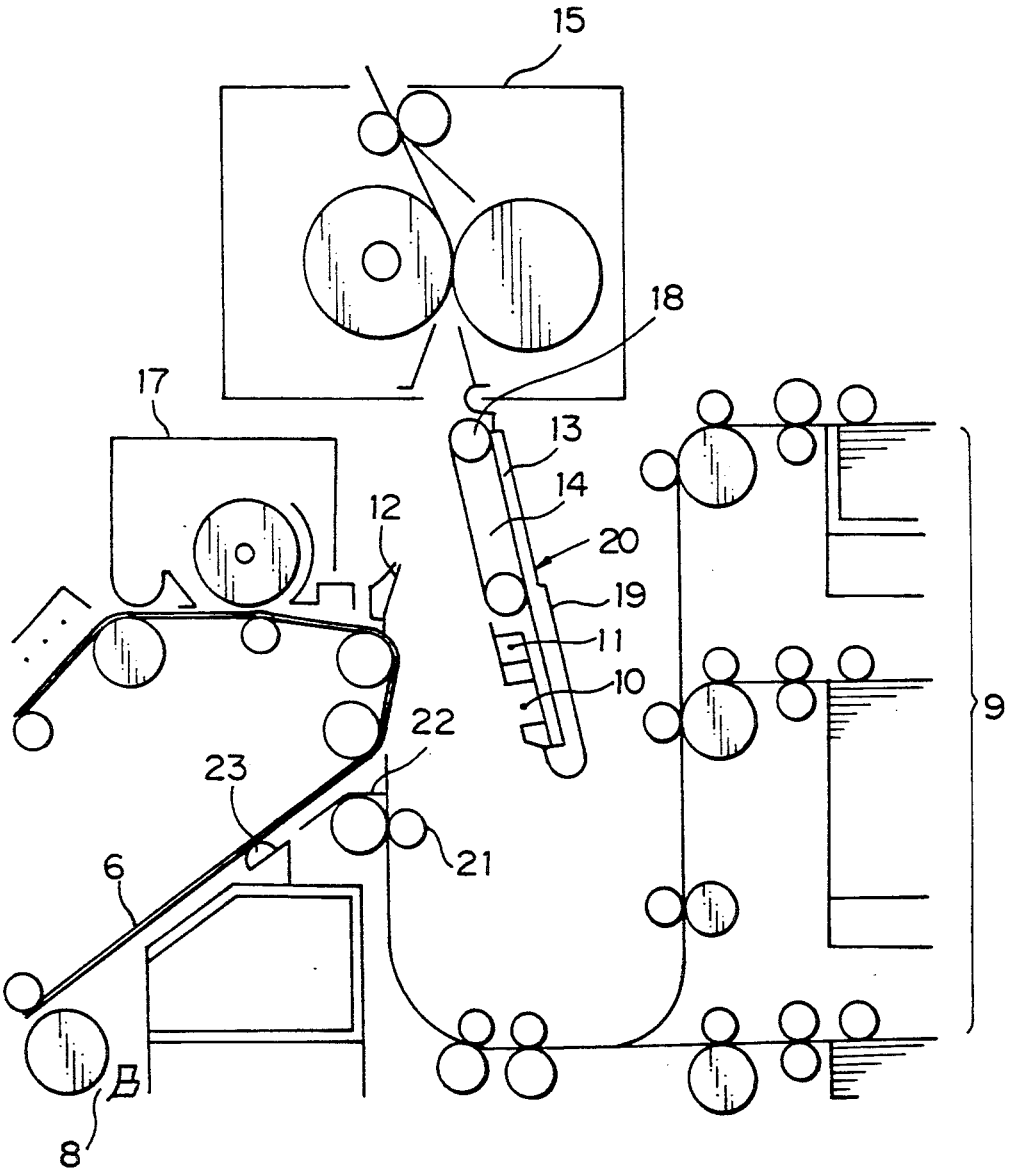
FIG. 2 is a fragmentary section of the copier shown in FIG. 1.
Figure 3:
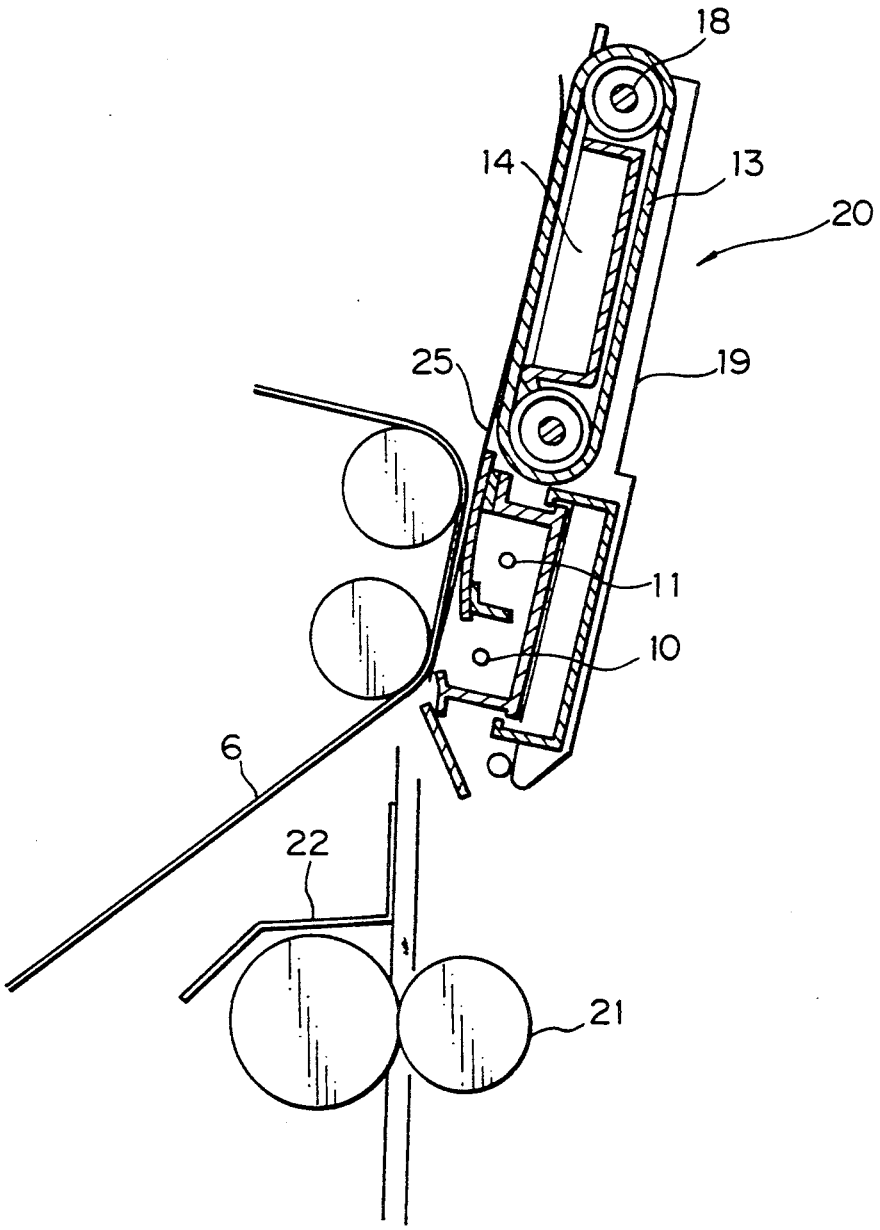
FIG. 3 is a view of an image transferring and paper separating unit included in the copier of FIG. 1 and held in an operative position.
Figure 4:
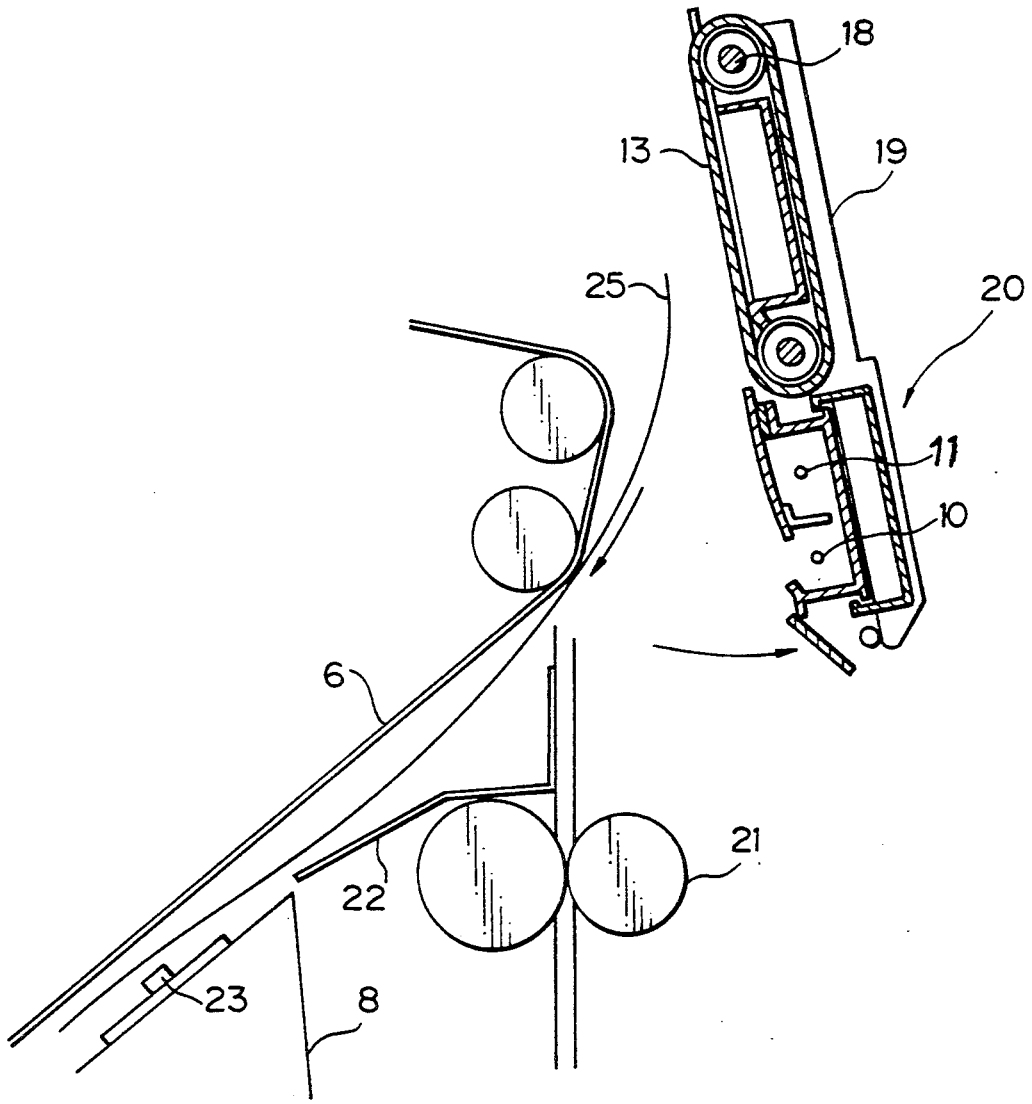
FIG. 4 is a view similar to FIG. 3, showing the unit in an inoperative position in which a jamming paper sheet may be removed.
Figure 5:
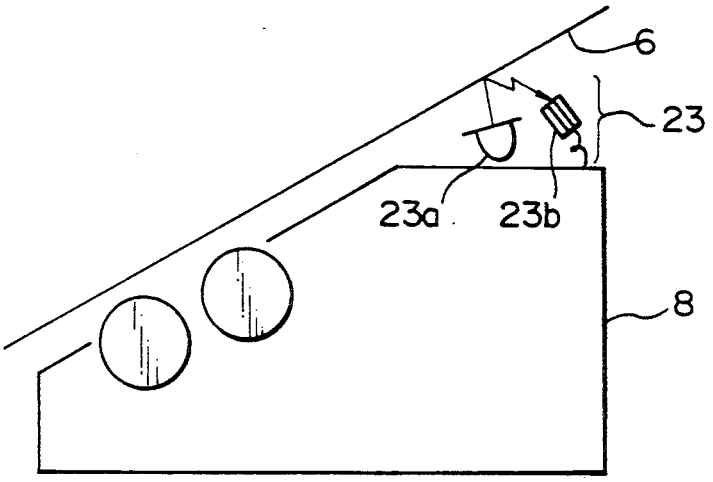
FIG. 5 shows a condition in which a toner density sensor senses the toner density on a photoconductive element.
Figure 6:
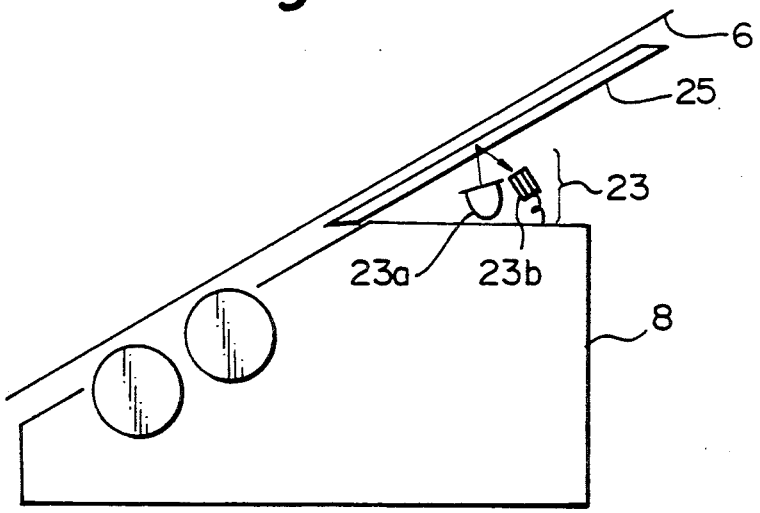
FIG. 6 shows a condition in which the sensor senses the toner density on a paper sheet slipped out of a transport path.

The image transferring and paper separating unit 20 has a transfer charger 10, a separation charger 11, a transport belt 13, and a suction device 14. As shown in FIGS. 2 to 4, these components of the unit 20 are mounted on a unit frame 19 and bodily movable toward and away from the surface of the belt 6. The unit 20 is usually held in contact with the surface of the belt 6, as shown in FIGS. 1 and 3. Assume that the paper sheet 25 has jammed the path between defined between the unit 20 and the belt 6. Then, the unit 20 is rotated about an upper shaft 18 to the position shown in FIG. 4. In the position shown in FIG. 4, the unit 20 is held in abutment against a stop, not shown, with the main charger 10 thereof spaced apart from the surface of the belt 6. A register roller 21 is located in the vicinity of the unit 20 while a bracket 22 is disposed above the register roller 21. A toner density sensor 23 is positioned in close proximity to the bracket 22. The toner density sensor 23 senses the density of a toner image representative of a reference pattern and formed on the surface of the belt 6. The reference pattern has a predetermined reference density. The supply of a toner is controlled on the basis of the output of the toner density sensor 23. As shown in FIGS. 5 and 6, the toner density sensor 23 is constituted by a light emitting element 23*a* such as a light emitting diode (LED) and a light-sensitive element 23*b* such as a phototransistor.

In operation, light issuing from the lamp 2 illuminates a document which is laid on the glass platen P. An imagewise reflection from the document is routed through the first mirror 3, lens 4 and second mirror 5 to the belt 6. At this instant, the surface of the belt 6 has already been cleaned by the cleaning unit 17 and uniformly charged by the main charger 7. As a result, the imagewise reflection forms a latent image on the surface of the belt 6. While the belt 6 with such a latent image is moved as indicated by an arrow in FIG. 1, the developing unit 8 develops the latent image to turn it into a toner image. The paper sheet 25 fed from the paper feeding section 9 is caused into contact with the toner image in an image transfer station between the rollers 6*c* and 6*d*. Then, the transfer charger 10 of the image transferring and paper separating unit 20 transfers the toner image from the belt 6 to the paper sheet 25. The paper sheet 25 carrying the toner image thereon is separated from the belt 6 by the separation charger 11 of the unit 20. The guide pawl 12 steers the leading edge of the paper sheet 25 coming out of the unit 20 toward the transport belt 13. The transport belt 13 conveys the paper sheet 25 to the fixing unit 15 while the suction device 14 sucks it against the belt 13. The paper sheet 25 having the toner image fixed thereon by the fixing unit 15 is driven out onto the copy tray 16.

To remove the paper sheet 25 jammed the transport path between the surface of the belt 6 and the image transferring and paper separating unit 20, the unit 20 is rotated about the upper shaft 18 to the position shown in FIG. 4, as stated earlier. At this time, the paper sheet 25 is apt to slip out of the transport path and drop along the surface of the belt 6 to a lower portion of the copier, as shown in FIG. 4. Specifically, the paper sheet 25 usually drops to the position where the toner density sensor 23 is located and stops at the position between the sensor 23 and the belt 6.

In the light of the above, the illustrative embodiment determines whether or not the jamming paper sheet 25 has dropped to the position where the toner density sensor 23 is located by using the toner density sensor 23. Specifically, when a door, not shown, of the casing C is opened to remove the jamming paper sheet 25, the toner density sensor 23 is turned on to sense the toner density on the surface of the belt 6 (see FIG. 5). Thereafter, when the door of the casing C is closed to end the operation, the toner density sensor 23 is again turned on to sense the toner density on the surface of the belt 6. At this instant, if the paper sheet 25 dropped along the belt 6 exists between the belt 6 and the toner density sensor 23, the output of the sensor 23 is representative of the toner density on the back or non-imaged side of the paper sheet 25 and not the toner density on the surface of the belt 6 (see FIG. 6). Generally, the surface of the belt 6 and the back of the paper sheet 25 greatly differ in toner density from each other. Hence, when the two successive outputs of the toner density sensor 23 are different by more than a predetermined value, it can be decided that the dropped paper sheet 25 exists. Of course, when such a paper sheet 25 does not exist between the belt 6 and the sensor 23, the output of the sensor 23 at the end of the operation will differ little from the output appeared at the beginning of the operation.

FIG. 5 shows the toner density sensor 23 which is sensing the toner density on the surface of the belt 6, while FIG. 6 shows the sensor 23 sensing the paper sheet 25 which has dropped along the surface of the belt 6. The surface of the belt 6 and that of the paper sheet 25 usually bear a dark color and a light color, respectively. When the toner density sensor 23 irradiates such two different kinds of surfaces by the LED 23*a*, different intensities of light are incident to the light-sensitive element 23*b*, resulting in different outputs of the sensor 23. To avoid erroneous detection, the illustrative embodiment compares the output voltage of the sensor 23 with a reference voltage and, when the former is greater than the latter, determines that the paper sheet 25 exists.

Figure 7:
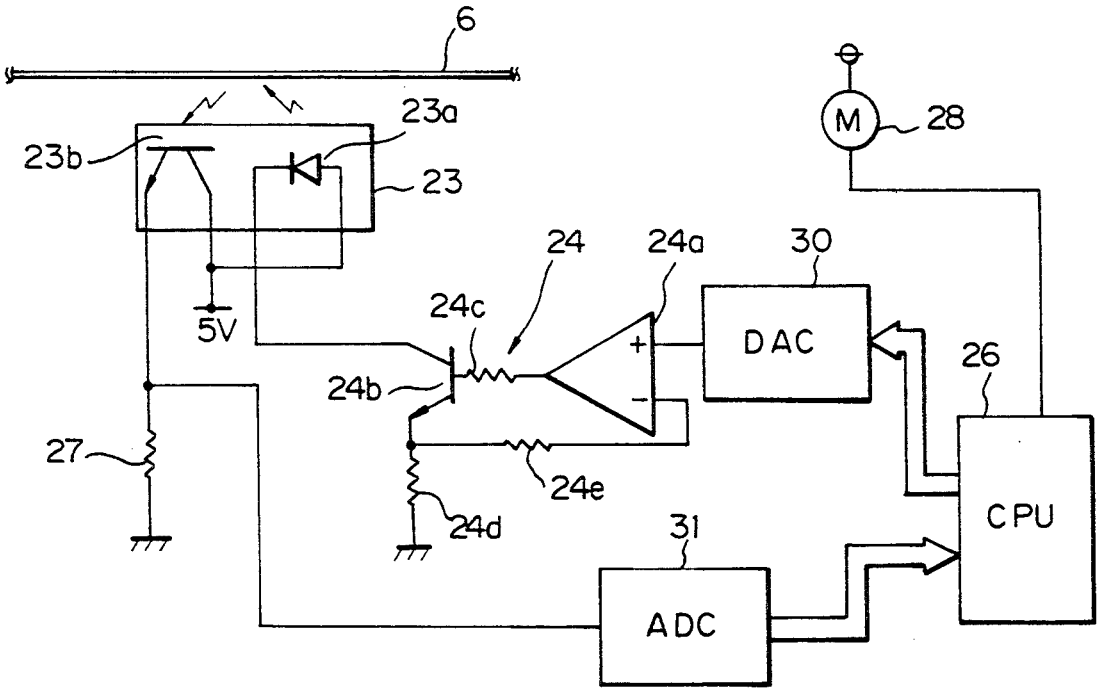
FIG. 7 is schematic block diagram showing control circuiry for practicing the illustrative embodiment.

The embodiment will be described more specifically with reference to FIGS. 7 to 9. FIG. 7 shows control circuitry of the illustrative embodiment. As shown, a CPU 26 feeds a control signal to a digital-to-analog converter (DAC) 30 which then converts the control signal into an analog signal. A constant current circuit 24 is connected to the DAC 30 and made up of an operational amplifier (OP AMP) 24*a*, a transistor 24*b*, and resistors 24*a*, 24*b* and 24*c*. The constant current circuit 24 causes the LED 23*a* of the toner density sensor 23 to be driven by a constant current. Light issuing from the LED 23*a* is incident to the surface o the belt 6, while a reflection from the belt 6 is incident to the phototransistor 23*b* of the sensor 23. As a result, a current associated with the amount of light incident to the phototransistor 23*b* flows through the resistor 27 which is connected to the phototransistor 23*b*. Hence, a voltage proportional to this current is inputted to an analog-to-digital converter (ADC) 31. The ADC 31 digitizes the input voltage and then delivers it to the CPU 26.

Figure 8:
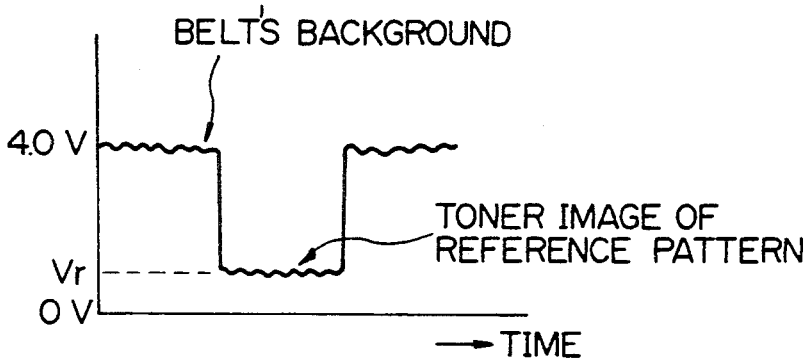
FIGS. 8 and 9 are graphs representative of specific operations of the toner density sensor.
Figure 9:
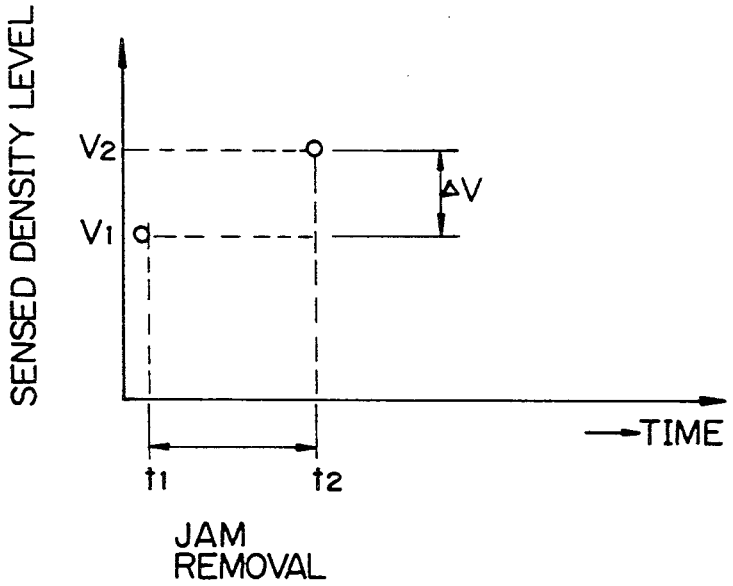

As shown in FIG. 8, the amount of light to issue from the LED 23*a* is controlled such that the voltage associated with the background of the belt 6 is 4 volts. When the toner density sensor 23 senses the density of the toner image (voltage Vr) representative of the reference pattern as stated previously, the CPU 26 feeds a control signal associated with the sensed density to a motor 28 included in a toner supply device. As a result, the motor 28 is selectively turned on and off to maintain the toner density constant. Usually, controlling the voltage associated with the background of the belt 6 to 4 volts and controlling the toner density on the basis of the sensed toner density of the reference pattern as stated above are effected immediately after the turn-on of the power switch of the copier and every time the copying cycle is repeated 500 consecutive times. In the illustrative embodiment, the toner density sensor 23 is also turned on when the paper sheet 25 has jammed the path, as stated earlier. Specifically, as shown in FIG. 9, the sensor 23 senses the toner density at a time $t_1$ when the paper sheet has jammed and a time $t_2$ when the operation associated with the removal of the paper sheet has been ended. A difference of $\Delta$ volt between the detected levels V1 and V2 indicates that the paper sheet has dropped.

Figure 10:
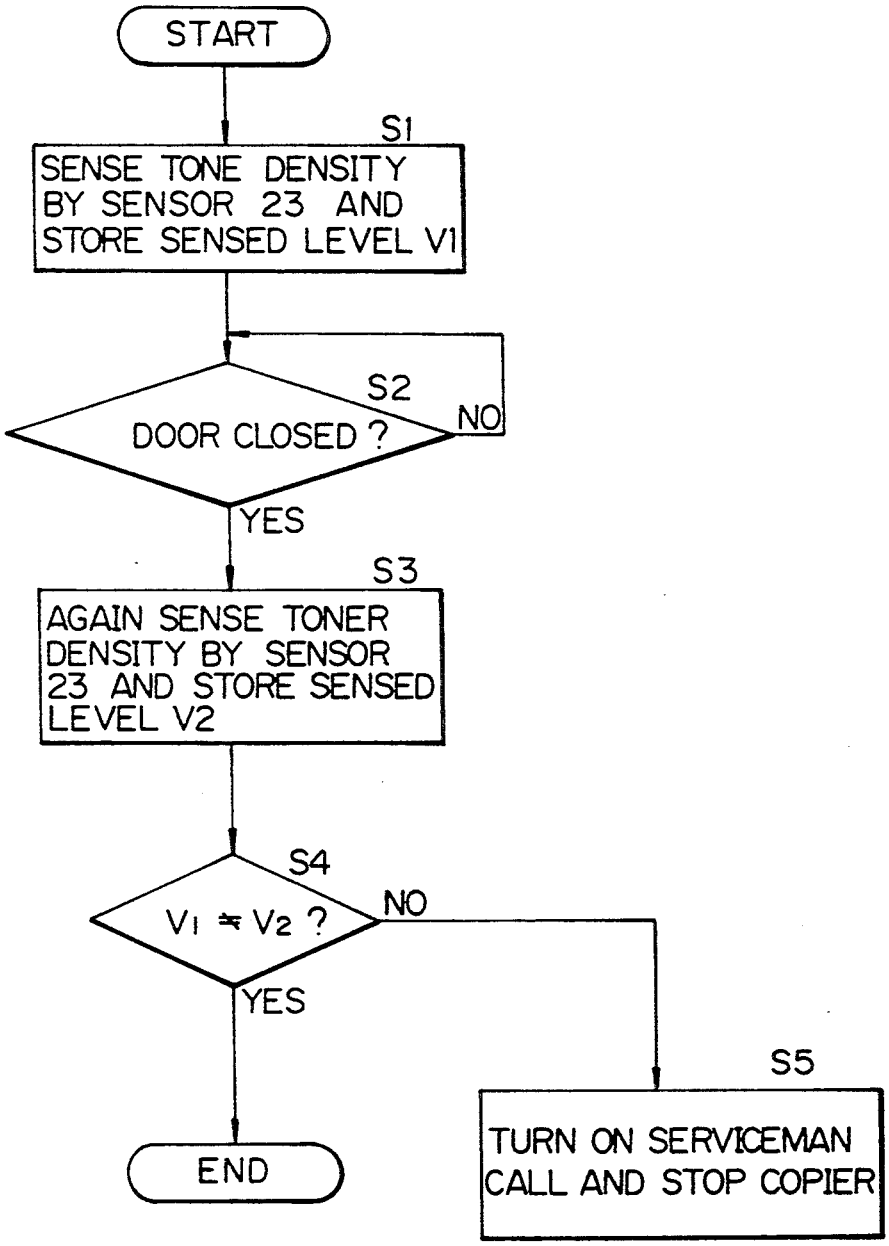
FIG. 10 is a flowchart demonstrating a specific operation of the control circuitry.

Referring to FIG. 10, a specific control procedure of the illustrative embodiment will be described. Assume that the operator has opened the door of the casing C at the time $t_1$, FIG. 9, in order to remove a jamming paper sheet. Then, in a step S1, the toner density sensor 23 senses the toner density, and the resultant output $V_1$ thereof is written to a memory. When the operator completes the paper removing operation and then closes the door of the casing C (S2), the toner density sensor 23 again senses the toner density at the time $t_2$, FIG. 9, to produce an output $V_2$ (S3). The output level $V_2$ is compared to the previous output level $V_1$ stored in the memory (S4). If the output level $V_2$ is not equal to the output level $V_1$ as determined in the step S4, an alarm for urging the operator to call a serviceman is generated and the copying operation is inhibited (S5). If the output levels $V_1$ and $V_2$ compare equal, meaning that no paper sheets have been dropped, ordinary post-processing associated with a paper jam is executed.

In the event of a paper jam, the operator opens the door of the casing C, and then rotates the image transferring and paper separating device 20 about the shaft 18 away from the belt 6 to the position shown in FIG. 4, as stated earlier. At this instant, when the jamming paper sheet has dropped along the surface of the belt 6, the toner density level $V_1$ of the background of the belt 6 and the toner density level of the paper sheet sensed at the times $t_1$ and $t_2$, respectively are, of course, different from each other. As a result, the alarm is produced and the copier is deactivated, as described above. This is successful in preventing the operator from driving the copier again without noticing the dropped paper sheet and, therefore, in eliminating a more serious paper jam.

As stated above, the embodiment determines whether or not the output level of the toner density sensor differs from the time when a paper jam occurs to the time when the paper removing operation completes. Hence, the decision is accurate even when the distance between the paper sheet and the sensor 23 is changed or when a two-sided copy mode operation is performed. While the illustrative embodiment detects the drop of a paper sheet by use of a toner density sensor usually installed in an electrophotographic copier of the type described, it may use an extra sensor independent of the toner density sensor.

Figure 11:
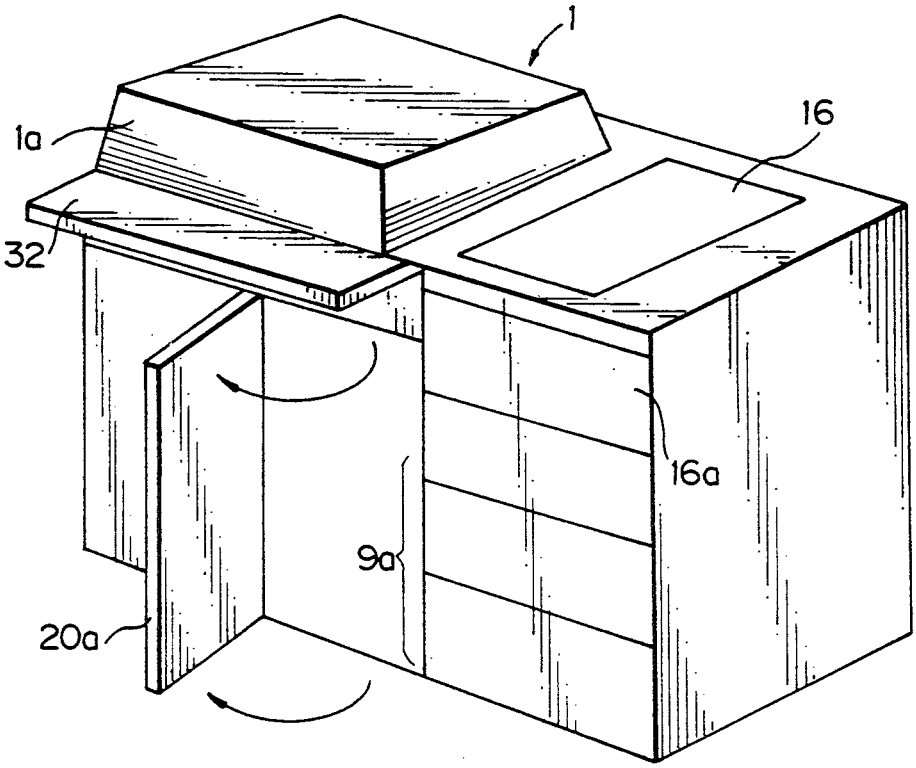
FIG. 11 is an external perspective view of an electrophotographic copier implemented with an alternative embodiment of the present invention.
Figure 12:
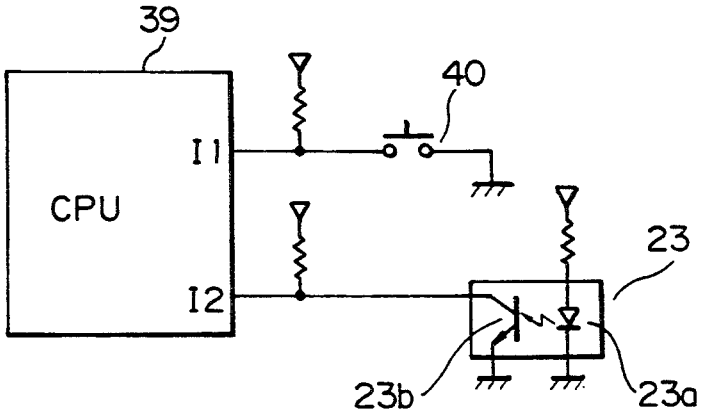
FIG. 12 shows control circuitry for practicing the alternative embodiments.

Referring to FIGS. 11 and 12, a copier to which an alternative embodiment of the present invention is applied will be described. In FIG. 12, a CPU 39 comprises a control program, memory, microprocessor, etc. A door switch 40 is associated with a front door 20*a* which is provided at the front of the copier. The door switch 40 and the toner density sensor 23 are respectively connected to input ports I1 and I2 of the CPU 39. In this configuration, only when the door switch 40 is opened and closed, the toner density sensor 23 and CPU execute the operation for detecting the paper sheet 25.

Figure 13:
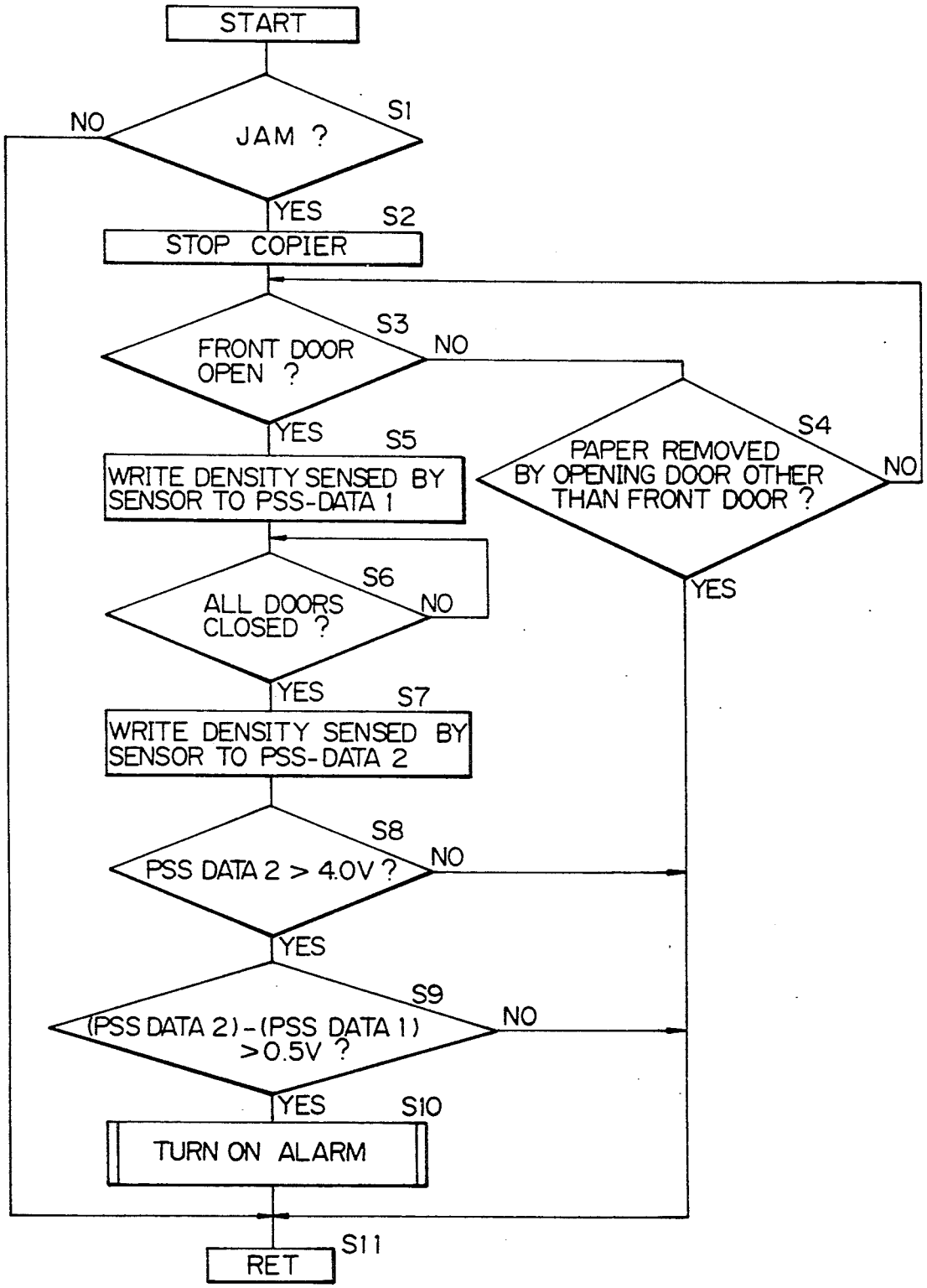
FIG. 13 is a flowchart showing a specific operation of the alternative embodiment.

FIG. 13 shows a specific operation of this embodiment for detecting a dropped paper sheet. As shown, the CPU 39 determines whether or not a jam has occurred (S1). If a jam has occurred, the CPU 39 stops the operation of the copier (S2). Then, the CPU 39 determines whether or not the front door 20*a* of the copier is open (S3). Assume that the jamming paper located in the step S1 can be removed without opening the front door, e.g., it has jammed the ADF 1 and can be removed if a door 1*a* of the ADF 1 is opened. Then, the program ends by way of a step S4 (S11). When the front door 20*a* is open as determined in the step S3, the LED 23*a* of the toner density sensor 23*a* is turned on to measure the resulting reflection. The measured value is written to a memory (PSS'DATA 1) (S5). Generally, the front door 20*a* is not always closed last after the paper removing operation. Hence, the CPU 39 determines whether or not all the doors, i.e., the front door 20*a*, the ADF door 1*a*, a door 9*a* of the paper feeding section 16, and a door 16*a* associated with the copy tray 16 as shown in FIG. 11 are closed (S6). If all of them are closed, the CPU 39 turns on the toner density sensor 23 again and writes the resulting measured value to a memory (PSS·DATA 2) (S7). Thereupon, the CPU 39 determines whether or not the value stored in the memory (PSS·DATA 2) is greater than 4.0 volts (S8) and, if the answer is positive, subtracts the value stored in the memory (PSS·DATA 1) from the value stored in the memory (PSS·DATA 2) (S9). If the difference produced in the step S9 is greater than 0.5 volt, the CPU 39 determines that a dropped paper sheet exists and displays an alarm on an operation board 32, FIG. 11, to inform the user of such an occurrence (S10). If desired, the copier may be connected to a communication line to automatically report the drop of the paper sheet to a person in charge.

In summary, the present invention detects a paper sheet dropped out of a paper transport path by use of a toner density sensor usually installed in a copier and thereby eliminates the need for an extra sensor. On detecting such a paper sheet, the present invention produces an alarm and stops the operation of the copier. This prevents the operator from driving the copier again without noticing the dropped paper sheet, thereby eliminating further and more complicated troubles. Furthermore, since the detection of the paper sheet is executed when only a particular door switch is opened and closed, malfunctions ascribable to signals from door switches except for the particular door switch are eliminated.

While the present invention has been shown and described in relation to an electrophotographic copier, it is of course applicable any other type of image recorder.

Various modifications will become possible for those skilled in the art after receiving the teachings of the present disclosure without departing from the scope thereof.

What is claimed is:

1. A control method for an image recorder comprising a transport path for transporting a recording medium substantially vertically from a lower portion to an upper portion of said recorder, a developing unit for developing a latent image electrostatically formed on an image carrier by a toner to produce a toner image, and an image transferring and medium separating unit extending along said transport path for transferring said toner image from said image carrier to said medium and then separating said medium from said image carrier, said method comprising the steps of:

(a) sensing a density of a toner image representative of a reference density pattern formed on said image carrier by way of a toner density sensor located adjacent to said image carrier, and setting said sensed density as a first sensed level;

(b) sensing, on the lapse of a predetermined period of time, a density of a toner image representative of said reference pattern formed on said image carrier by said toner density sensor, and setting said sensed density as a second sensed level;

(c) comparing said first sensed level and said second sensed level; and (d) determining, when said first sensed level and said second sensed level are different from each other, that the medium has slipped out of said transport path and exists in the vicinity of said toner density sensor, and then executing necessary processing.

2. A method as claimed in claim 1, wherein step (a) comprises:

(e) turning on said toner density sensor when an operation for removing the medium having jammed the transport path is started; and (f) storing said first sensed level.

3. A method as claimed in claim 2, wherein step (b) comprises (g) turning on said toner density sensor when said operation is completed.

4. A method as claimed in claim 3, wherein step (d) comprises (h) producing an alarm when the medium is determined to exist in the vicinity of said toner density sensor.

5. A method as claimed in claim 4, wherein step (d) further comprises (i) stopping a recording operation of said image recorder in response to said alarm.

6. A method as claimed in claim 5, wherein said image recorder further comprises a casing comprising a front door associated with said transport path, said image transferring and medium separating unit, said developing unit, and said image carrier, and other doors associated with other components.

7. A method as claimed in claim 6, wherein step (e) is executed only when said front door is opened, while step (g) is executed only when said front door is closed.

8. A method as claimed in claim 6, wherein step (e) is executed only when said front door is opened, while step (g) is executed when all of said front door and said other doors are closed.

9. A control method for an image recorder wherein said image recorder has a transport path for transporting a recording medium substantially vertically from a lower portion to an upper portion of said recorder, a developing unit for developing a latent image electrostatically formed on an image carrier by a toner to produce a toner image, an image transferring and medium separating unit extending along said transport path for transferring said toner image from said image carrier to said medium and then separating said medium from said image carrier, and a toner density sensor located adjacent to said image carrier, said method comprising the steps of:

(a) sensing a density of a toner image representative of a reference density pattern formed on said image carrier by said toner density sensor, and setting said sensed density as a first sensed level by turning on said toner density sensor when an operation for removing any medium having jammed the transport path is started and by storing said first sensed level;

(b) sensing, on the lapse of a predetermined period of time, a density of a toner image representative of said reference pattern formed on said image carrier by said toner density sensor, and setting said sensed density as a second sensed level;

(c) comparing said first sensed level and said second sensed level; and (d) determining, when said first sensed level and said second sensed level are different from each other, that the medium has slipped out of said transport path and exists in the vicinity of said toner density sensor, and then executing necessary processing.

10. A method as claimed in claim 9, wherein step (b) comprises:

(e) turning on said toner density sensor when said operation is completed.

11. A method as claimed in claim 10, wherein step (d) comprises:

(f) producing an alarm when the medium is determined to exist in the vicinity of said toner density sensor.

12. A method as claimed in claim 11, wherein step (d) further comprises:

(g) stopping a recording operation of said image recorder in response to said alarm.

13. A method as claimed in claim 12, wherein said image recorder further comprises:

providing a casing comprising a front door associated with said transport path, said image transferring and medium separating unit, said developing unit, and said image carrier, and other doors associated with other components.

14. A method as claimed in claim 13, wherein step (a) is executed only when said front door is opened, while step (e) is executed only when said front door is closed.

15. A method as claimed in claim 13, wherein step (a) is executed only when said front door is opened, while step (e) is executed when all of said front door and said other doors are closed.

* * * * *